United States Patent [19]

Freed

[11] Patent Number: 4,887,506

[45] Date of Patent: Dec. 19, 1989

[54] STRINGED MUSICAL INSTRUMENT WITH MAGNETIC PICKUPS

[75] Inventor: Mark L. Freed, Santa Monica, Calif.

[73] Assignee: Noma Video Inc., Los Angeles, Calif.

[21] Appl. No.: 102,486

[22] Filed: Sep. 29, 1987

Related U.S. Application Data

[63] Continuation-in-part of Ser. No. 850,257, Apr. 11, 1986, Pat. No. 4,697,492.

[51] Int. Cl.[4] ..... G10H 3/18

[52] U.S. Cl. ..... 84/727; 84/DIG. 30

[58] Field of Search ..... 84/1.14, 1.15, 1.16, 84/314 R, 293, DIG. 27, DIG. 24, DIG. 30

[56] References Cited

U.S. PATENT DOCUMENTS

| | | | |
|---|---|---|---|
| 3,465,086 | 9/1969 | Borell | 84/1.15 X |
| 3,763,736 | 10/1973 | Williams | 84/1.15 X |
| 3,868,880 | 3/1975 | Chapman | 84/267 |
| 4,137,813 | 2/1979 | Stone et al. | 84/314 R |
| 4,142,436 | 3/1979 | Chapman | 84/1.16 |
| 4,240,319 | 12/1980 | Soupios | 84/DIG. 30 X |
| 4,697,491 | 10/1987 | Maloney | 84/1.16 X |
| 4,697,492 | 10/1987 | Freed | 84/1.16 |

*Primary Examiner*—Stanley J. Witkowski
*Attorney, Agent, or Firm*—Philip D. Junkins

[57] ABSTRACT

An electric guitar type stringed musical instrument having an elongated fingerboard, an upper headpiece and nut and a lower tailpiece and bridge, with a first set of primary frets placed in regular sequence along the fingerboard from its upper end to its lower end and a set of secondary frets each placed intermediate a pair of primary frets along the fingerboard. Each secondary fret is in off-set diagonal orientation with respect to the primary frets and is so placed between primary frets that upon tapping of a string of the instrument at a point below a secondary fret with depression of the string to contact the secondary fret and a lower primary fret two harmonically resolved, bi-directional musical notes are generated through the string. One of such notes is related to the length of the portion of the string between the lower primary fret and the bridge of the instrument and is picked up by a pickup head of a lower magnetic pickup assembly. The other of such notes is related to the length of the portion of the string between the secondary fret and the nut of the instrument and is picked up by a pickup head of an upper magnetic pickup assembly incorporated in the nut. In effect, bi-directional musical notes are created on each string through the tapping thereof and a unique harmonious musical stereo-effect is generated.

5 Claims, 2 Drawing Sheets

STRINGED MUSICAL INSTRUMENT WITH MAGNETIC PICKUPS

RELATED APPLICATION

The present application is a continuation-in-part of my co-pending application Ser. No. 850,257 filed Apr. 11, 1986, now U.S. Pat. No. 4,697,492 granted Oct. 6, 1987.

BACKGROUND OF THE INVENTION

1. Field of the Invention

The present invention relates generally to stringed musical instruments and method of playing same and more particularly to stringed musical instruments having an elongated fretted fingerboard with a plurality of tensioned strings, immediately above the fingerboard, which are strummed or plucked with a pick or with the fingers, or are tapped with the fingers.

2. Description of the Prior Art

Stringed musical instruments which are plucked have been known for nearly 3,000 years with earliest origins in the Middle East and the Orient. The most popular fretted instrument in the United States has been the "guitar." The guitar usually has 6 strings but may have as few as 4 (base guitar) and as many as 12 strings. Other fretted, stringed instruments of the guitar family include: the "lute," popular in Europe during the 1500's and 1600's (6 strings); the "balalaika" with Russian origin (2–4 strings); the "mandolin" (4–5 double strings of wire); the "banjo" (4 or more strings) with its drumlike body and long fretted neck; the "ukullele," a small guitar of Portuguese origina popularized in Hawaii (typically has 4 strings); and the "Spanish guitar" of Spanish origin in the 1500's.

The modern guitar is comprised basically of an elongated fingerboard or neck terminating in an upper headpiece which includes a number of string tensioning members (tuning pegs). The fingerboard bears a series of spaced frets (narrow metal cross strips) against which the strings are stopped (pressed) to vary the effective length of the strings and thus the musical sound of the strings. Commonly, guitars are provided with 20 to 26 frets. The fingerboard terminates at its lower end in a tailpiece or soundboard. The strings are tensioned over the fingerboard, and its frets, between a headpiece nut and the tailpiece bridge. The lower ends of the strings, beyond the bridge, are anchored in known manner to the tailpiece. The upper ends of the strings, beyond the nut, are attached to the tuning pegs of the headpiece.

The great majority of present-day guitars, and instruments of the guitar family, include electronic means and systems for amplifying the musical notes produced by the vibrations of the strings when actuated as by being plucked by a plectum (pick) or strummed or tapped by the player's fingers. In electric guitars, the sound amplifying means usually comprises a set of magnetic pickups, each pickup being situated close to (most often directly under) a string, and the electric outputs of the pickups are fed to electric amplifier devices of well-known design. The set of pickups is located on the tailpiece between the bridge and the nearest fret on the fingerboard.

It is a principal object of the present invention to provide novel construction of electric guitars which generate bi-directional notes by the plucking, strumming or tapping of the guitar strings.

It is a further principal object of the invention to provide a unique method of playing the electric bi-directional guitars of the invention.

It is a still further object of the invention to provide novel construction of bi-directional electric guitars having elongated fretted fingerboards.

It is another object of the invention to provide a unique method of playing electric guitars which generate bi-directional notes by the plucking, strumming or tapping of the guitar strings.

Other objects and advantages of the invention will become apparent from a reading of the following summary and detailed description of a preferred embodiment of the invention, taken in connection with the accompanying drawings.

SUMMARY OF THE INVENTION

The present invention relates to unique and improved electric guitars having elongated fretted fingerboards and to the method of playing same. As previously described, the typical electric stringed instrument of the guitar family has a set of magnetic pickups located on the tailpiece or soundboard between the bridge and the nearest fret on the fingerboard. The musical notes and chords that are picked up are those generated by string vibrations between the fret upon which a given string is depressed (stopped) and the bridge.

The guitars of this invention have an additional or secondary set of frets on the fingerboard interposed between a selected number of the standard or primary frets as disclosed in the aforementioned application Ser. No. 850,257, now U.S. Pat. No. 4,697,492 granted Oct. 6, 1987. The secondary frets on the fingerboard of the guitars of the present invention are, however, offset with respect to the primary frets to provide an improved system of scale intervals. While the guitars of the earlier application included a secondary set of magnetic pickups located on the fingerboard adjacent the headpiece of the instrument, the secondary set of magnetic pickups of the present invention are incorporated in the headpiece nut. The guitars of the invention are played by depressing (stopping) the strings between a primary fret and a secondary fret whereby a depressed string, although tapped, plucked or strummed in the area between the stopping frets and the bridge, generates string vibrations in two directions and of two different amplitudes. Thus, two different (but harmonically related) notes are created, one of which is picked up by a magnetic pickup of the primary set of pickups and the other of which is picked up by a magnetic pickup of the secondary set of pickups in the headpiece nut. The unique fingerboard and fret arrangement, with magnetic pickup sets at each end of the fingerboard, allows the guitar-playing musician to sound two harmonically resolved notes simultaneously when tapping, plucking or strumming one string. Four note chords can be produced by tapping, plucking or strumming two strings, and so on. Harmonized solo line melodies can be played on the same string. Further, the musician can obtain note octaves on one string at the same time and can superimpose single notes above sustained chords which are normally silent and muted. Triads can be created with the right hand only and these can be extended harmonically into harp-like arpeggio textures. Also, it is possible to separate the directionality of the notes discretely into two separate pitch paths. In effect, bi-directional notes are crated on each string with each tapping, plucking or strumming thereof and a unique harmonious musical stereo-effect is generated.

DETAILED DESCRIPTION OF A PREFERRED EMBODIMENT OF THE INVENTION

Figure 1:
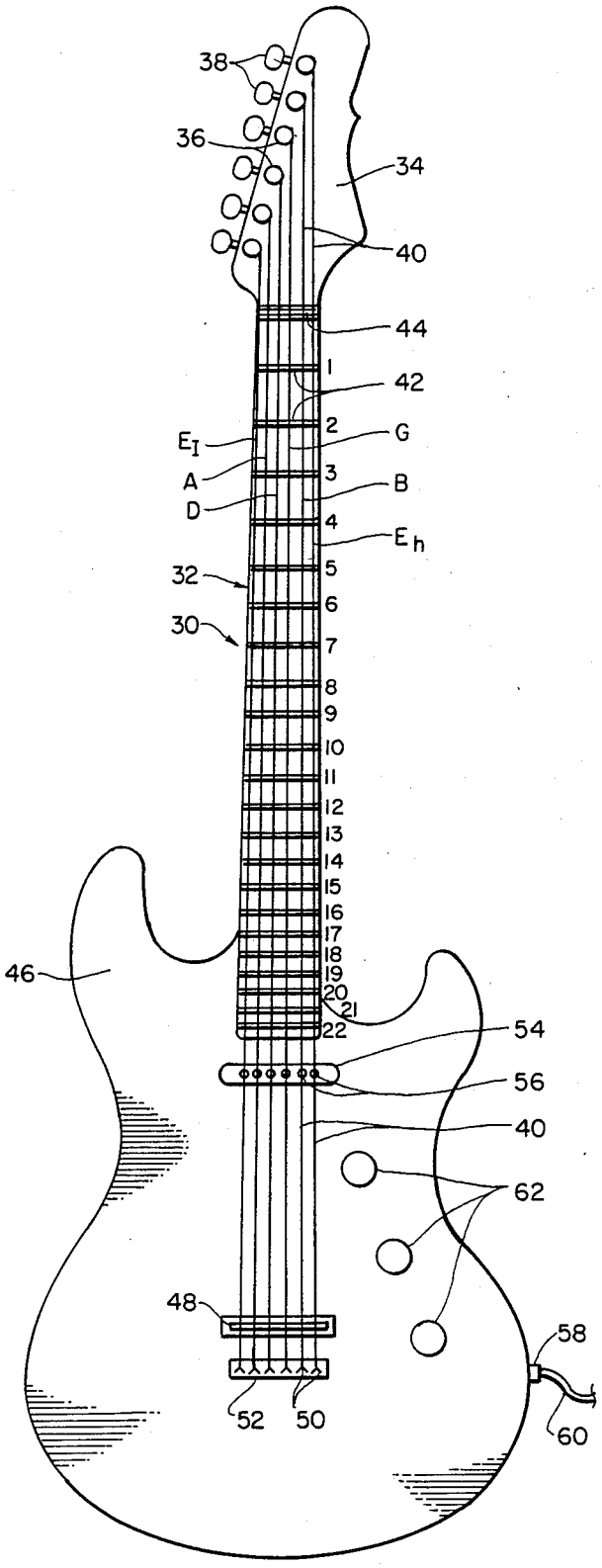
FIG. 1 is a front view of a 6 string, 22 fret, electric guitar of the type in general use at the present time showing a typical arrangement of the frets along the fingerboard and a set of magnetic pickups on the tailpiece of the instrument.

Referring initially to FIG. 1, there is shown a typical electrical guitar as an example of a stringed musical instrument having an elongated fretted fingerboard. The exemplary guitar, generally indicated by the number 30, is comprised of an elongated fingerboard 32 terminating at its upper end in a headpiece 34 which includes a number of string tensioning member 36 (pegs) which are adjusted in their rotation and string tensioning function by their respective tuning knob 38 for each of the strings 40. Fingerboard 32 is provided with a series of frets 42, each comprising a transverse and raised rib on the upper surface of the fingerboard. The guitar illustrated in FIG. 1 includes 22 frets numbered 1 to 22 with fret number 1 located near the nut 44 at the upper end of the fingerboard at the point where the fingerboard 32 joins with the headpiece 34. Fret number 22 is located as the last fret at the lower end of the fingerboard where the fingerboard joins the tailpiece or soundboard 46 of the guitar 30. Substantially all fretted, stringed musical instruments have their frets along their fingerboards in accordance with a repeating mathematical progression based upon the placement of the 12th fret, counting from the nut position, at a point half-way between the nut and the bridge. The 5th fret and the 24th fret (if utilized) are at the quarter divisions between the nut and the bridge. The 7th fret and the 19th fret are located at positions from the nut and bridge, respectively, one-third of the distance from the nut to the bridge. The total distance between any five frets is the same as the total distance between the following seven frets. Thus, the distance between the nut and the 5th fret is equal to the distance between the 5th fret and the 12th fret and the distance between the 7th fret and the 12th fret is equal to the distance between the 12th fret and the 19th fret. The strings 40 extend from their respective tensioning pegs 36, over nut 44 (appropriately grooved to maintain string spacing), in parallel along the fingerboard (over the spaced frets 42), to and over bridge 48 (located at the lower end of the tailpiece 46) and finally to their respective anchor points 50 on and within anchor member 52 on the tailpiece 46. The bridge 48 is appropriately grooved to maintain string spacing at the soundboard end of the guitar.

Mounted on the tailpiece or soundboard 46, below strings 40, is a magnetic pickup assembly indicated generally at 54 and comprised of individual pickups 56 located below the strings 40. As is well known in the art, the magnetic pickup assembly 54 serves to produce electric signals which are a function of the musical notes produced by the strings on the fingerboard 32, and feeds out signal s(as a function of the musical notes) through a plug 58 and a cable 60 to an electrical amplifier (not shown) of known design. The pickup assembly 54 may be provided with appropriate on-off, tone and volume control knobs 62. The magnetic pickup assembly 54, individual pickups 56, plug 58, cable 60 and control knobs 62 are conventional and well known in the electronic stringed musical instrument art.

As previously noted, the strings 40, six in number, extend over substantially the entire length of the guitar from their respective anchor points 50 on and within the anchor member 52 to their respective tensioning members 36 and, as is conventional, the strings 40 extend slightly above the frets 42 formed on the upper surface of the fingerboard 32. For a six string guitar of the type illustrated in FIG. 1 the strings are typically tuned in the sequence $E_1$, A, D, G, B and $E_h$ from low E ($E_1$) to high E ($E_h$). The G, B and $E_h$ strings are usually single wires of progressively (G to $E_h$) smaller diameter with the $E_h$ string of highest musical pitch. The $E_1$, A and D strings are usually dual wound strings of progressively (D to $E_1$) larger diameter with the $E_1$ string of lowest musical pitch. As is well known in the fretted, stringed musical instrument art, note variations for each string are attained by depressing (stopping) the string to a given fret. As a string is depressed (stopped) to a selected fret nearer the tailpiece the note produced by tapping, plucking or strumming the string between the stopping fret and the bridge is higher in tone and the individual magnetic pickup beneath such string picks up the higher note. Depression of each string to a stopping fret is accomplished by finger pressure applied to the string behind the fret (far side of the fret with respect to the bridge). Thus, if it is desired to stop the B string on fret number 5 the string B is depressed between the 4th and 5th fret.

Figure 2:
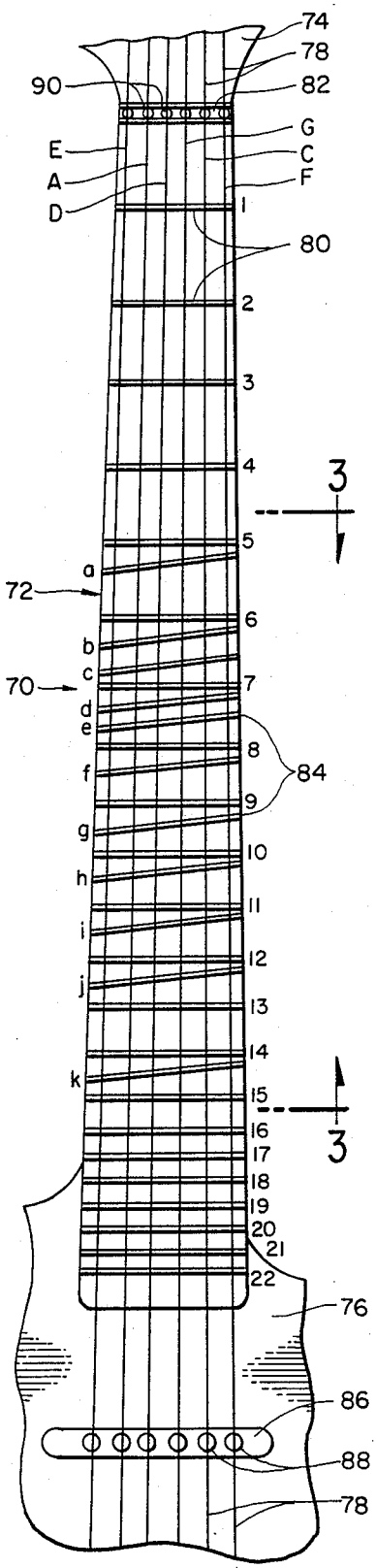
FIG. 2 is a front view of the fingerboard section of a guitar of the present invention showing the standard set of frets and an interposed secondary set of frets (offset with respect to the primary frets) along the fingerboard and a secondary set of magnetic pickups incorporated in the headpiece nut.

Referring now to FIG. 2, there is shown, in an enlarged front view, the fingerboard section of a bi-directional note guitar in accordance with the present invention. The guitar, generally indicated by the number 70, is comprised of an elongated fingerboard 72 terminating at its upper end in a headpiece 74 (not shown in full) and at its lower end in a tailpiece 76 (also not shown in full). Appropriate string tensioning members and their respective tuning knobs are provided, as with the guitar headpiece of FIG. 1, for strings 78. Fingerboard 72 is provided with a first series of standard or primary frets 80, each comprised of a transverse and raised metallic rib on the upper surface of the fingerboard. As illustrated in FIG. 2, the first set of twenty-two standard frets numbered 1 to 22 are placed in the same position along the fingerboard as the twenty-two frets of the guitar of FIG. 1. Again, fret number 1 is located near nut 82 at the upper end of the fingerboard with fret number 22 located as the last fret at the lower end of the fingerboard. Also located on the fingerboard 72 is a series of secondary frets 84 selectively interposed in off-set (non-parallel) fashion between the standard or primary frets 80. This secondary series of frets includes, as illustrated, eleven off-set frets numbered a to k and, as described hereinafter, cooperate with frets 5 and 15 of the primary series of frets to create the unique bi-directional, harmonically resolved musical tone effects produced by the fretted, stringed musical instruments of the invention The strings 78 extend from their respective tensioning pegs (not shown) on the headpiece 74, over nut 82 (appropriately grooved to maintain string spacing), in parallel along the fingerboard 72 (over the first series of frets 80 and over the interposed second series of frets 84), to and over a bridge (not shown) on the tailpiece 76 and finally to their respective anchor points (not shown) on the tailpiece. Mounted on the tailpiece or soundboard 76, below strings 78, is a first or primary magnetic pickup assembly indicated generally at 86 and comprised of individual pickups 88 located below the strings 78. Incorporated in the nut 82 (at the upper end of the fingerboard 72), below strings 78, is a second or secondary magnetic pickup assembly comprised of individual pickups 90 located below strings 78. As in the case of the standard electric guitar illustrated in FIG. 1, the magnetic pickup assembly 86 is of a type well known in the art and serves to produce electric signals which are a function of the musical notes produced by the strings on the fingerboard over the respective individual pickups 88, and feeds out signals (as a function of the musical notes at each pickup point) through a cable (now shown) to an electric amplifier (not shown) of known design. In like fashion, the secondary magnetic pickup assembly (comprised of the individual pickups 90 of well known design) serves to produce electric signals which are a function of the musical notes produced by the strings on the fingerboard over the respective individual pickups 90 with such signals fed by cable to the amplifier. Each of the pickup assemblies may be provided with appropriate on-off, tone and volume controls (not shown) located in a convenient area on the tailpiece of soundboard 76

In accordance with the unique dual fret series on the fingerboard and the dual pickup assemblies of the fretted, stringed musical instrument of the invention, either a single note or bi-directional notes (harmonically resolved) may be produced by each string. If a given string is merely plucked or strummed without depression of such string to a fret, the basic note sound of the string is picked up by the respective individual pickups of both pickup assemblies (the pickup assembly 86 on the tailpiece 76 and the assembly of pickups 90 in the nut 82). If a string is depressed between adjacent frets of the two series of frets, a different note is generated by the string in opposing directions from the adjacent frets. For example, if string C between the number 11 fret (primary series of frets) and the letter h fret (secondary series of frets) is tapped to stop the string against such frets, the string note generated between fret 11 and the bridge (lower direction) is a B picked up by pickup assembly 86 and the note generated by such string between fret h and the nut 82 (upper direction) is a D picked up by the pickup 90 located in nut 82 under the C string.

The off-set placement of the secondary series of frets (frets a–k as illustrated in FIG. 2) within the primary series of frets (between primary frets 5 and 15 as illustrated in FIGURE 2) on the fingerboard yields an improved system of scale intervals and is dictated by the resolution of musical note harmony between the bi-directional notes generated from the adjacent primary and secondary frets. It will be noted that, for the exemplary fingerboard of FIG. 2, there is no secondary fret between primary frets 13 and 14. It is further to be noted that there are two secondary frets (b and c) between primary frets 6 and 7 and two secondary frets (d and e) between primary frets 7 and 8. In accordance with the invention, it has been discovered that between primary fret pair 13 and 14 no bi-directional notes can be generated by the placement of a secondary fret which will be in harmony, i.e. with the placement of a secondary fret between this primary fret pair only dissonant bi-directional notes that are disconcordant (harmonically unresolved) are produced.

It should be noted (by reference to FIG. 2) that no secondary off-set frets are placed between the nut and the number 1 fret or between the numbers 1, 2, 3, 4 and 5 frets. It has been discovered that it is impractical to place secondary frets on the fingerboard in these spaces between primary frets because the notes generated in the direction of the nut from such secondary frets (if so placed) fall within the inaudible range. Also, it has been found impractical to locate secondary off-set frets between primary frets 15 through 22 because of the limited space between such primary frets.

Figure 3:
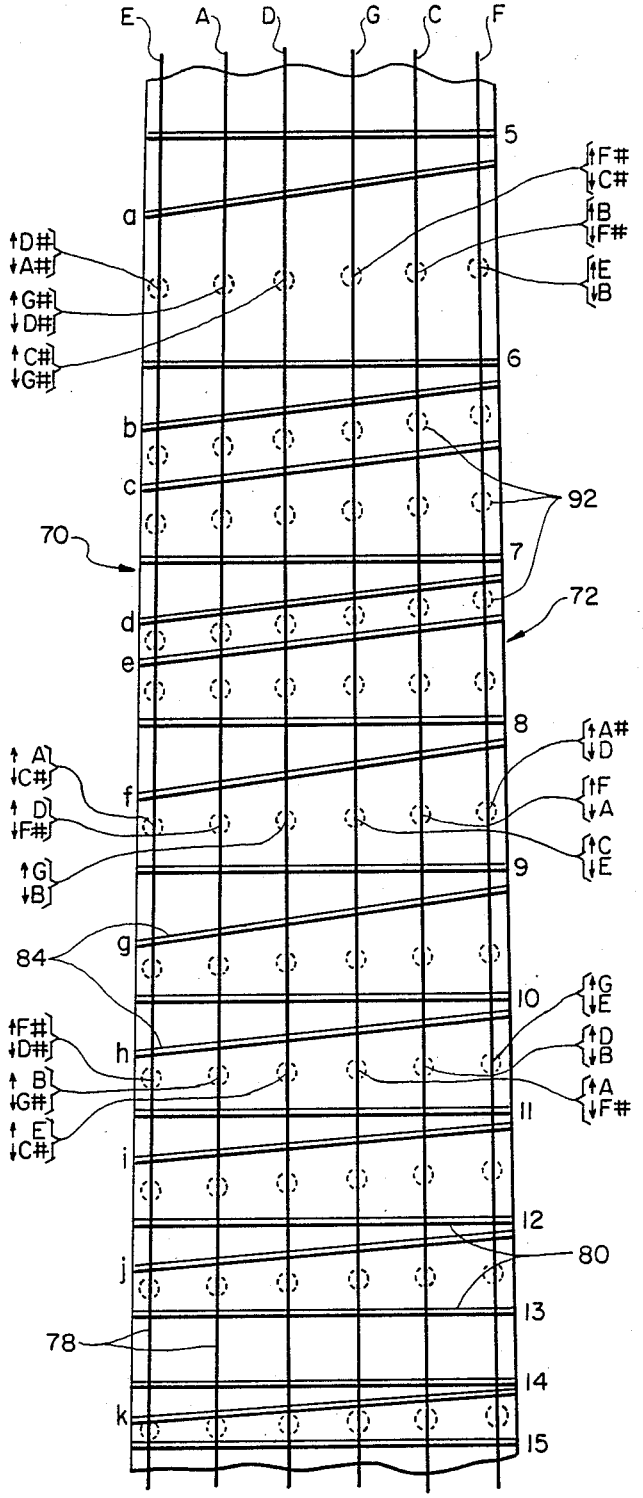
FIG. 3 is an enlarged front view of the middle section of the fingerboard of the guitar of FIG. 2 between standard fret 5 and standard fret 15 of such guitar.

FIG. 3 is an enlarged view of the middle section of the fingerboard of the guitar 70 of FIG. 2 of the invention. Standard frets 5 through 15 are illustrated on the fingerboard 72 and the secondary frets a through k are shown in their interposed off-set positions between frets 5 through 15. The following table shows (for the exemplary guitar string and secondary fret arrangement of FIG. 2) the bi-directional lower notes (the notes generated by string portions between a lower fret to which the strings are depressed by tapping and the bridge) and upper notes (the notes generated by string portions between an upper fret to which the strings are depressed by tapping and the nut) which are harmonically resolved and picked up, respectively, by the pickups 88 of the lower magnetic pickup assembly 86 and the pickups 90 incorporated in the nut 82 in accordance with the present invention. The points or spots of string tapping between each pair of primary and secondary frets, or pair of secondary frets (such as fret pairs b - c and d - e) are shown as dotted circles 92 in FIG. 3. It will be noted from FIG. 3 that string tapping to generate bi-directional notes in accordance with the invention is always performed behind or lower than an off-set or diagonal secondary fret, i.e., on the far side of a diagonal secondary fret with respect to the nut at the upper end of the fingerboard. As further illumination of the invention, there is included in FIG. 3 indication of the specific notes generated by tapping of the strings (with depression of the strings to fret pairs) between three illustrative pairs of frets, i.e., fret pair a - 6, fret pair f - 9 and fret pair h - 11. The direction of each note is indicated by the arrow adjacent each of the generated notes. Thus, tapping of the A string between frets a and 6 will result in a G# note being created by the A string portion between fret a and the nut and a D# note being created by the A string portion between fret 6 and the lower bridge, the created G# note being picked up by a pickup 90 of the upper magnetic pickup assembly in the nut and the created D# note being picked up by a pickup 88 of the lower magnetic pickup assembly 86.

TABLE I

| | | BI-DIRECTIONAL NOTES | | | | | |
|---|---|---|---|---|---|---|---|
| Strings | | E | A | D | G | C | F |
| Fret Pair | a ↑ | D# | G# | C# | F# | B | E |
| | 6 ↓ | A# | D# | G# | C# | F# | B |
| Fret Pair | b ↑ | C# | F# | B | E | A | D |
| | c ↓ | C | F | A# | D# | G# | C# |
| | c ↑ | C | F | A# | D# | G# | C# |

TABLE I-continued

| | | BI-DIRECTIONAL NOTES | | | | | |
|---|---|---|---|---|---|---|---|
| Strings | | E | A | D | G | C | F |
| Fret Pair | | | | | | | |
| | 7 ↓ | B | E | A | D | G | C |
| | d ↑ | B | E | A | D | G | C |
| Fret Pair | | | | | | | |
| | e ↓ | A# | D# | G# | C# | F# | B |
| | e ↑ | A# | D# | G# | C# | F# | B |
| Fret Pair | | | | | | | |
| | 8 ↓ | C | F | A# | D# | G# | C# |
| | f ↑ | A | D | G | C | F | A# |
| Fret Pair | | | | | | | |
| | 9 ↓ | C# | F# | B | E | A | D |
| | g ↑ | G | C | F | A# | D# | G# |
| Fret Pair | | | | | | | |
| | 10 ↓ | D | G | C | F | A# | D# |
| | h ↑ | F# | B | E | A | D | G |
| Fret Pair | | | | | | | |
| | 11 ↓ | D# | G# | C# | F# | B | E |
| | i ↑ | F | A# | D# | G# | C# | F# |
| Fret Pair | | | | | | | |
| | 12 ↓ | E | A | D | G | C | F |
| | j ↑ | E | A | D | G | C | F |
| Fret Pair | | | | | | | |
| | 13 ↓ | F | A# | D# | G# | C# | F# |
| | k ↑ | D | G | C | F | A# | D# |
| Fret Pair | | | | | | | |
| | 15 ↓ | G | C | F | A# | D# | G# |

There is thus provided a totally new and unique fretted, stringed musical instrument that generates string vibrations in two directions and of different note amplitudes. Thus, with the tapping of each string behind or below a diagonal secondary fret of the instrument two different, but harmonically resolved (related) notes are crated, one of which is picked up by a lower magnetic pickup in the pickup assembly located between the lower end of the fingerboard and the bridge and the other of which is picked up by an upper magnetic pickup in the pickup assembly incorporated in the nut. The dual series fret arrangement of the instrument allows the musician to sound two notes simultaneously from one string. Further, the musician can obtain note octives on one string at the same time and can superimpose single notes above sustained chords which are normally silent or muted. Through the instruments, bi-directional notes are generated on each string and a unique harmonious musical stereoeffect is created. It is to be noted that the stringed instrument of the invention, with the upper magnetic pickup assembly inactivated, can be played in the same fashion as a standard stringed fretted instrument with the strings depressed or tapped behind the standard frets and the strings strummed or picked between such frets and the bridge.

It is to be noted that a number of fretted stringed instruments (particularly guitar-type instruments) have been designed with dual (parallel) fretted fingerboards and thus have dual headpieces and tailpieces or soundboards. The present invention, relating to the use of a secondary set of off-set frets on a fingerboard and a second magnetic pickup assembly incorporated in the nut at the junction of the fingerboard and the headpiece, includes the application of such features and structures to dual fingerboards, headpieces and tailpieces in any form of fretted stringed guitar-type instrument.

In the specification and drawing figures there has been set forth a preferred embodiment of the invention and although specific terms have been employed, they are used in a generic and descriptive sense only and not for purposes of limitation, the scope of the invention being defined in the following claims.

What I claim is:

1. In a stringed musical instrument of the electric guitar family of instruments, in combination:

(a) an instrument body including an elongated fingerboard having a front face surface for bearing frets, a headpiece extending upwardly from the fingerboard and a tailpiece extending downwardly from the fingerboard;

(b) a string-supporting nut on said fingerboard proximate said headpiece and a string-supporting bridge on said tailpiece;

(c) a plurality of selectively adjustable string tensioning members mounted on said headpiece;

(d) a plurality of strings extending parallel to and above the front face surface of the fingerboard, each string being attached at its upper end to one of said tensioning members, extending over said nut and over said bridge, and being anchored at its lower end to said tailpiece;

(e) a set of primary frets each extending across the fingerboard on the front face surface thereof and positioned in regular sequence along the fingerboard, below and traverse of said strings;

(f) a first magnetic pickup assembly carried by said tailpiece between said bridge and said fingerboard and including a plurality of magnetic pickup heads, each adjacent to and in operative relationship with one of said strings;

(g) a second magnetic pickup assembly incorporated in said nut and including a plurality of magnetic pickup heads, each adjacent to and in operative relationship with one of said strings; and (h) a set of secondary frets each extending across the fingerboard on the front face surface thereof and positioned between a pair of primary frets along the fingerboard and in off-set non-parallel orientation with respect to said primary frets, each secondary fret being so placed between two primary frets that upon tapping depression of a string of the instrument between and into contact with any adjacent pair of a primary fret and a secondary fret two harmonically resolved musical notes are generated through said string with one of said notes being generated by the string portion between said adjacent pair of frets upon which the string is in depressed contact and the bridge and picked up by a pickup head of the first magnetic pickup assembly carried by the tailpiece and the second of said notes being generated by the string portion between said adjacent pair of frets upon which the string is in depressed contact and the nut and picked up by a pickup head of the second assembly incorporated in said nut.

2. The stringed musical instrument as claimed in claim 1 wherein said instrument has at least 2 strings, at least 2 primary frets and at least 1 secondary fret.

3. The strings musical instrument as claimed in claim 1 wherein said instrument has from 4 to 12 strings, from 18 to 26 primary frets and from 10 to 14 secondary frets.

4. The stringed musical instrument as claimed in claim 1 wherein the harmonically resolved note picked up by a pickup head of the first magnetic pickup assembly is related to the length of the portion of said string between the lower fret to which said string is depressed and said bridge and the harmonically resolved note picked up by a pickup head of the second magnetic pickup assembly is related to the length of the portion of said string between the upper fret to which said string is depressed and said nut.

5. In a stringed musical instrument of the electric guitar family of instruments, in combination:

(a) an instrument body including an elongated fingerboard having a front face surface for bearing frets, a headpiece extending upwardly from the fingerboard and a tailpiece extending downwardly from the fingerboard;

(b) a string-supporting nut affixed to and extending across the fingerboard proximate said headpiece and a stringsupporting bridge mounted on said tailpiece;

(c) a plurality of selectively adjustable string tensioning members mounted on said headpiece;

(d) a plurality of strings extending parallel to and above the front face surface of the fingerboard, each string extending over said string-supporting nut and being attached at its upper end to one of said tensioning members and extending over said string-supporting bridge and being anchored at its lower end to said tailpiece.

(e) a set of primary frets each extending across the fingerboard on the front face surface thereof and positioned in regular sequence along the fingerboard from its upper end to its lower end, below and transverse of said strings;

(f) a first magnetic pickup assembly carried by said tailpiece between said bridge and said fingerboard and including a plurality of magnetic pickup heads, each of said heads being positioned adjacent to and in operative relationship with one of said strings;

(g) a second magnetic pickup assembly incorporated in said nut and including a plurality of magnetic pickup heads, each of said heads being positioned adjacent to and in operative relationship with one of said strings; and (h) a set of secondary frets each extending across the fingerboard on the front face surface thereof and positioned between a pair of primary frets along the fingerboard in off-set diagonal orientation with respect to said primary frets, each secondary fret being so placed between the primary frets the, upon taping of a string of the instrument at a point below a secondary fret with depression of said string into contact with said secondary fret and a lower primary fret, two generated through said string with one of said notes being generated by the string portion between said lower primary fret and the bridge and being related to the length of the portion of said string between said lower primary fret and the bridge and picked up by a pickup head of the first magnetic pickup assembly carried by the tailpiece and with the second of said notes being generated by the string portion between said secondary fret and the nut and being related to the length of the portion of said string between said secondary fret and the nut and picked up by a pickup head of the second pickup assembly incorporated in said nut.

* * * * *